US011459864B1

(12) United States Patent
Batarseh

(10) Patent No.: US 11,459,864 B1
(45) Date of Patent: Oct. 4, 2022

(54) HIGH POWER LASER IN-SITU HEATING AND STEAM GENERATION TOOL AND METHODS

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/319,701

(22) Filed: May 13, 2021

(51) Int. Cl.
*E21B 43/24* (2006.01)
*H05B 6/00* (2006.01)

(52) U.S. Cl.
CPC ..... *E21B 43/24* (2013.01); *H05B 6/00* (2013.01); *H05B 2214/03* (2013.01)

(58) Field of Classification Search
CPC ..... E21B 43/11
See application file for complete search history.

(56) References Cited

U.S. PATENT DOCUMENTS 4,228,856 A 10/1980 Reale
6,888,097 B2 5/2005 Batarseh
7,487,834 B2 * 2/2009 Reed ..... E21B 43/11 166/302
8,748,687 B2 6/2014 Sirdeshpande
9,353,612 B2 5/2016 Batarseh
9,453,400 B2 9/2016 Wheeler et al.
9,644,464 B2 5/2017 Batarseh
9,796,047 B2 10/2017 Saenger
9,939,421 B2 4/2018 Batarseh et al.
(Continued)

FOREIGN PATENT DOCUMENTS

CN 203081295 U 7/2013
CN 109025950 A 12/2018
(Continued)

OTHER PUBLICATIONS

Batarseh, Sameeh et al.; "Flow Enhancement by High Power Laser Technology" IPTC-19308-MS, International Petroleum Technology Conference, Beijing, China, Mar. 26-28, 2019; pp. 1-7.
(Continued)

*Primary Examiner* — William D Hutton, Jr.
*Assistant Examiner* — Avi T Skaist
(74) *Attorney, Agent, or Firm* — Bracewell LLP; Constance G. Rhebergen; Eleanor L. Tyson

(57) ABSTRACT

An apparatus for producing in-situ steam comprising a rotational joint, the steam generating tool comprising an optics unit configured to shape and manipulate laser energy delivered to the optics unit through the fiber optic cable to produce a laser beam, an optical cover, an activated carbon case configured to contain activated carbon, the activated carbon case comprising a laser end configured to allow the laser beam to pass while containing the activated carbon, a reinforced end configured to stop the laser beam while containing the activated carbon, wherein the laser beam travels from the optical cover to the laser end of the activated carbon case through the activated carbon case and ends at the reinforced end, and activated carbon, an outer case, wherein an annulus is formed between the outer case and the activated carbon case, and water supply pipes configured to carry water to the annulus.

15 Claims, 7 Drawing Sheets

(56) References Cited

U.S. PATENT DOCUMENTS

| | | | | |
|---|---|---|---|---|
| 2004/0256103 | A1 | 12/2004 | Batarseh | |
| 2009/0200032 | A1 | 8/2009 | Foret | |
| 2013/0228372 | A1 | 9/2013 | Linyaev et al. | |
| 2014/0090839 | A1* | 4/2014 | Al-Nakhli | C09K 8/72 507/269 |
| 2014/0190691 | A1 | 7/2014 | Vinegar et al. | |
| 2014/0360778 | A1 | 12/2014 | Batarseh | |
| 2021/0229219 | A1 | 7/2021 | Alabbad et al. | |

FOREIGN PATENT DOCUMENTS

| | | | |
|---|---|---|---|
| NZ | 607028 | A | 8/2014 |
| WO | 2011112513 | A2 | 9/2011 |
| WO | 20160004323 | A3 | 1/2016 |
| WO | 2017100354 | A1 | 6/2017 |
| WO | 20170163265 | A1 | 9/2017 |

OTHER PUBLICATIONS

Batarseh, Sameeh I. et al.; "High Power Laser Technology in Downhole Applications, Reshaping the Industry" SPE-188507-MS, Abu Dhabi International Petroleum Exhibition & Conference, Abu Dhabi, UAE, Nov. 13-16, 2017; pp. 1-15.

International Search Report and Written Opinion for International Application No. PCT/US2022/028788, dated Jul. 29, 2022; pp. 1-16.

International Search Report and Written Opinion for International Application No. PCT/US2022/028789, dated Jul. 29, 2022; pp. 1-15.

Othman, Haitham et al.; "Effective Wellbore Stimulation Methods Utilizing Advanced Thermal Technologies" OTC-30056-MS, Offshore Technology Conference Asia, Nov. 2-6, 2020; pp. 1-15.

* cited by examiner

HIGH POWER LASER IN-SITU HEATING AND STEAM GENERATION TOOL AND METHODS

TECHNICAL FIELD

Disclosed are apparatus and methods for steam production. More specifically, embodiments related to apparatus and methods that incorporate lasers for steam production are provided.

BACKGROUND

Enhanced oil recovery is a branch of petroleum engineering that focuses on recovery of reservoir heavy oil through enhanced flow from the formation to the wellbore for production. Heavy oil can be defined as having an API gravity of less than 29 with a viscosity greater than 5000 cP, To produce heavy oil from a formation, the communication between the formation containing the heavy oil and the wellbore needs to be improved such that the heavy oil flows to the surface, therefore, viscosity reduction is a must for the flow.

One method of reducing viscosity of the heavy oil is to increase the temperature in the formation. Increased temperature in different forms can lower viscosity and allow the oil to flow. Increased temperatures can be introduced by steam injection, in-situ combustion or electromagnetic heating, including through the use of microwave. Use of radio frequencies can only reach temperatures of 800° C. and cannot be precisely controlled. Steam injection uses steam as a thermal heating method.

There are several issues and limitations with conventional methods using steam to increase the temperature of the formation. Heat loss is one of the main issues due to the steam traveling via the steam pipes for long distances. Heat loss occurs because the pipes are split several time to distribute the steam for different injector wells, which causes heat loss especially in the cold and in the winter season. Heat loss also occurs in the wellbore when the steam travels from the wellhead to the injector. Heat loss causes losses of steam quality which makes it inefficient. Another concern is the safety of conventional steam methods, as the steam travels on the surface via pipelines, the pipelines can be damaged with time, rust or accident which causes hot steam to vent in the air and causes damage to anything which the steam comes in contact.

SUMMARY

Disclosed are apparatus and methods for steam production. More specifically, embodiments related to apparatus and methods that incorporate lasers for steam production are provided.

In a first aspect, an apparatus for producing in-situ steam is provided. The apparatus includes a rotational joint physically connected to a fiber optic cable, the rotational joint configured to rotate a steam generating tool around an axis, and the steam generating tool. The steam generating tool includes an optics unit physically connected to the rotational joint and configured to shape and manipulate laser energy delivered to the optics unit through the fiber optic cable to produce a laser beam, an optical cover optically connected to the optics unit and configured to protect the optics unit, and an activated carbon case optically connected to the optics unit and configured to contain activated carbon. The activated carbon case includes a laser end proximate to the optical cover and configured to allow the laser beam to pass while containing the activated carbon, a reinforced end opposite the laser end, configured to stop the laser beam while containing the activated carbon, where the laser beam travels from the optical cover to the laser end of the activated carbon case through the activated carbon case and ends at the reinforced end, and activated carbon configured to retain and radiate heat. The steam generating tool further includes an outer case physically surrounding the activated carbon case, where an annulus is formed between the outer case and the activated carbon case, where heat from the activated carbon radiates to the annulus, and water supply pipes configured to carry water to the annulus, where each water supply pipe terminates in a one-way valve, where the outer case includes release valves.

In certain aspects, the apparatus further includes a surface unit configured to produce laser energy, where the surface unit sits on a surface, and the fiber optic cable configured to transmit the laser energy from the surface unit to the steam generating tool. In certain aspects, the laser end is selected from an optical mesh, an optical, and combinations of the same. In certain aspects, the activated carbon case is constructed from activated carbon. In certain aspects, the one-way valve is a check valve. In certain aspects, the activated carbon is in the shape of gravel. In certain aspects, the optics unit includes one or more lenses. In certain aspects, the steam generating tool further includes an optical case extending from the optical unit to the laser end, the optical case configured to isolate the laser beam from the water supply pipes.

In a second aspect, a method of producing in-situ steam is provided. The method includes the steps of producing laser energy in a surface unit, transmitting the laser energy to a steam generating tool through a fiber optic cable, converting the laser energy to a laser beam in an optics unit of the steam generating tool, emitting the laser beam from the optics unit to an activated carbon case, where the laser beam enters the activated carbon case through a laser end, where the activated carbon case includes activated carbon, where the laser beam contacts the activated carbon, increasing a temperature of the activated carbon to produce a hot activated carbon, radiating heat from the activated carbon to an annulus between an outer case and the activated carbon case, where the temperature in the annulus is 1750° C., introducing water from a water supply pipes to the annulus, producing steam in the annulus due to the increase in temperature of the water in the annulus, and releasing the steam through release valves in the outer case.

In certain aspects, where the surface unit sits at a surface proximate to a wellbore in a formation such that the steam released through the release valves increases a temperature of the wellbore in the formation. In certain aspects, where the laser beam is a pulsed laser beam. In certain aspects, where the laser beam is a continuous laser beam. In certain aspects, the method further includes the step of pre-heating the water in the water supply pipes due to contact between the laser beam and the water supply pipes. In certain aspects, where the step of increasing the temperature of the activated carbon is a duration of 30 seconds to 3 minutes. In certain aspects, the method further includes the step of rotating the steam generating tool such that steam is evenly distributed from the release valves.

BRIEF DESCRIPTION OF THE DRAWINGS

These and other features, aspects, and advantages will become better understood with regard to the following descriptions, claims, and accompanying drawings. It is to be noted, however, that the drawings illustrate only several embodiments and are therefore not to be considered limiting of the inventive scope as it can admit to other equally effective embodiments.

In the accompanying Figures, similar components or features, or both, may have a similar reference label.

DETAILED DESCRIPTION

While the scope will be described with several embodiments, it is understood that one of ordinary skill in the relevant art will appreciate that many examples, variations and alterations to the apparatus and methods described are within the scope and spirit of the embodiments. Accordingly, the embodiments described here are set forth without any loss of generality, and without imposing limitations. Those of skill in the art understand that the inventive scope includes all possible combinations and uses of particular features described in the specification. In both the drawings and the detailed description, like numbers refer to like elements throughout.

Described are an apparatus and methods for producing steam in-situ using laser energy. The steam generating tool combines laser energy combined with activated carbon to generate in-situ steam. The steam generating tool can be used to produce heavy oil, for stimulation, and for offshore steam injection. Advantageously, when the activated carbon is exposed to the laser energy it heats up instantly reaching high temperatures in seconds. The activated carbon in the steam generating tool can be in the form of gravel. A laser beam passes through the activated carbon and heating it up, then water is injected and the heat converts the water to steam. The steam can be used to increase a temperature of the formation to produce heavy oil or can be used for stimulation.

Advantageously, the steam generating tool described combines high power laser energy with activated carbon to generate heat and steam without damaging the formation. Advantageously, the steam generating tools produces in-situ steam which reduces the heat loss as steam does not travel from the surface. Advantageously, the steam generating tool is a compact tool that can fit through the wellbore and be positioned in the formation. Advantageously, the steam generating tool allows for temperature increase of activated carbon in less than 3 minutes to temperatures greater than 1700° C. Advantageously, the steam generating tool can produce in-situ steam in less than 3 minutes. Advantageously, the steam generating tool provides a method for in-situ steam generation and eliminates heat lost as the steam is generated.

As used throughout, "activated carbon" refers to carbon that has been treated with the result being a highly porous carbon with increased surface area.

As used throughout, "steam quality" refers to the proportion of saturated steam (vapor) in a mixture of saturated condensate (liquid) and saturated steam (vapor). Steam quality of 0 indicates 100% condensate (liquid), while a steam quality of 100 indicates 100% saturated steam (vapor). Steam with a "high steam quality" is greater than 75, and alternately between 75 and 100.

Figure 1:
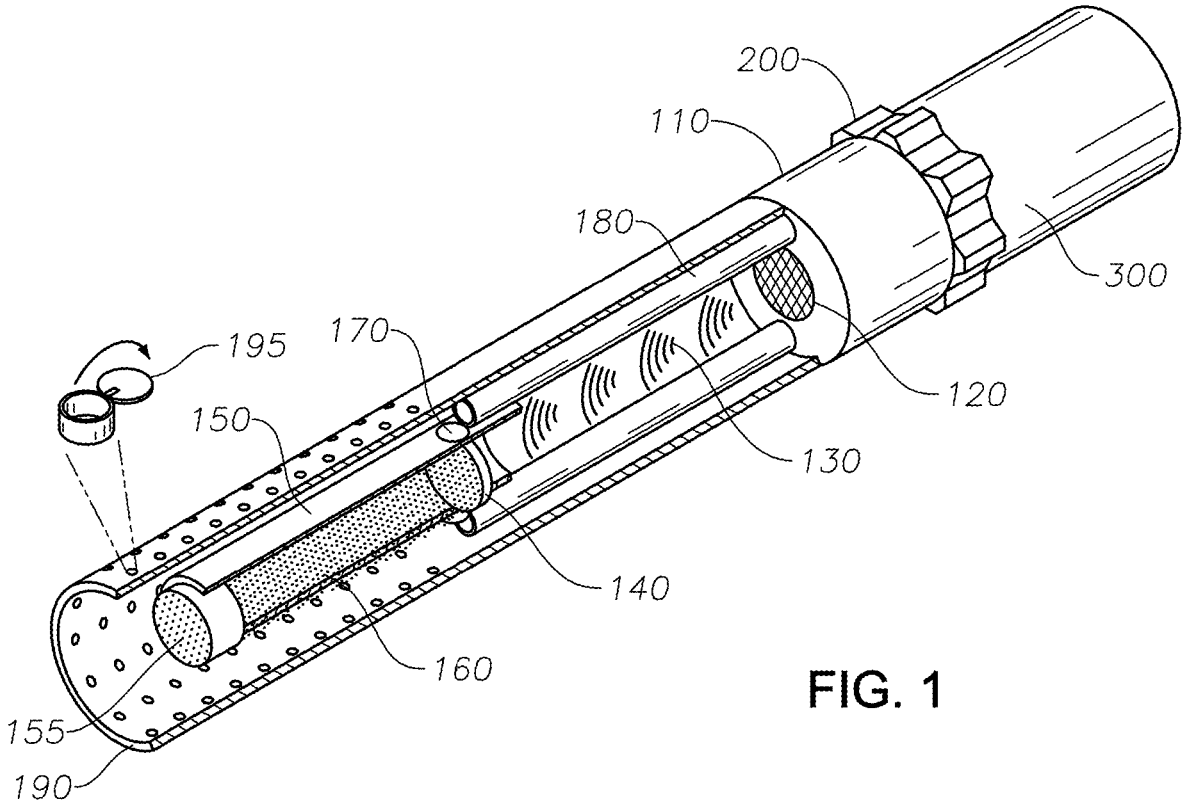
FIG. 1 is a perspective view of an embodiment of the steam generating tool.
Figure 2:
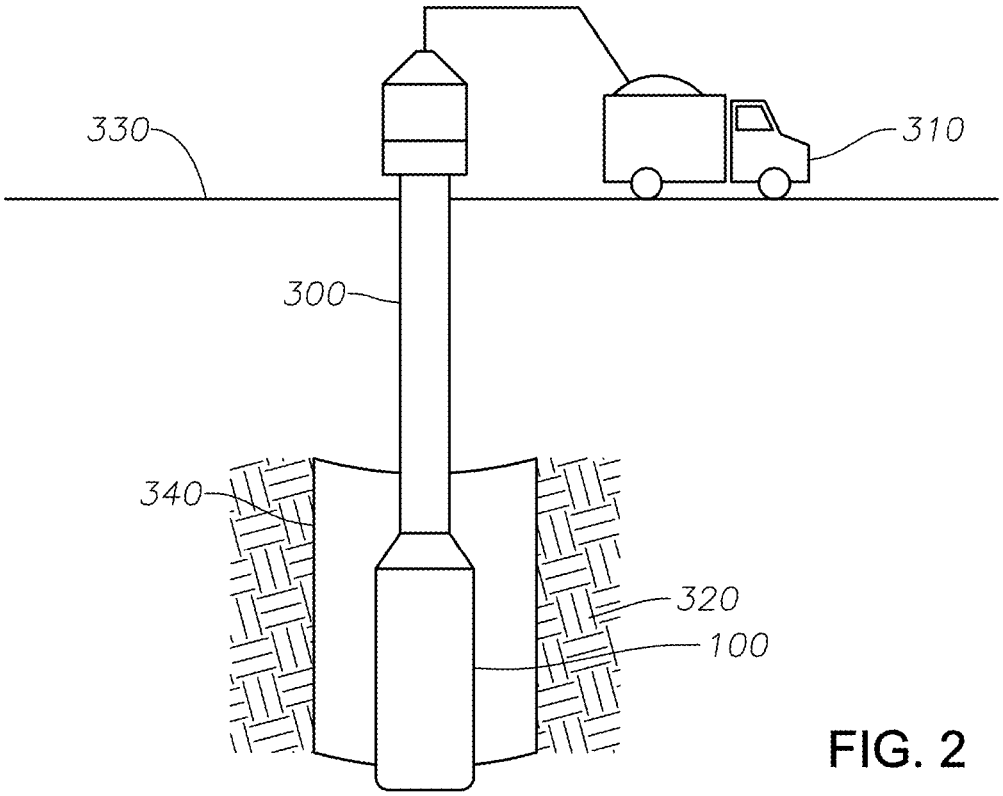
FIG. 2 is an orthogonal view of an embodiment of the steam generating tool.

The steam generating tool to produce in-situ steam can be understood with reference to FIG. 1. Steam generating tool 100 is connected to fiber optic cable 300 by rotational joint 200. As can be understood with reference to FIG. 2, fiber optic cable 300 connects surface unit 310 to steam generating tool 100. Fiber optic cable 300 carries laser energy from surface unit 310 positioned at a surface proximate to the formation. Surface unit 310 produces the laser energy. Surface unit 210 can be any type of laser generating unit capable of producing laser energy with more than 2 kW power. In at least one embodiment, surface unit 310 can include ytterbium fiber laser at a wavelength of 1062 nm.

Returning to FIG. 1, rotational joint 200 allows steam generating tool 100 to rotate around an axis such that the steam generated can be targeted to a precise section of the formation and the heat and steam can be distributed uniformly. Rotational joint 200 can be any type of rotatable joint used in downhole applications, including rotational joints that are hydraulically powered, battery powered, preprogrammed, or controlled from the surface.

The laser energy delivered through fiber optic cable 300 exits fiber optic cable 300 through optics unit 110. Optics unit 110 can include one or more lenses that can shape, manipulate, and shape and manipulate the laser energy to produce a laser beam. The size of the laser beam can be manipulated in optics unit 110. Optics unit 110 is protected by optical cover 120. Optical cover 120 can be any type of material configured to allow a laser beam to pass while preventing dust, debris, steam, or water from entering optics unit 110.

Figure 3:
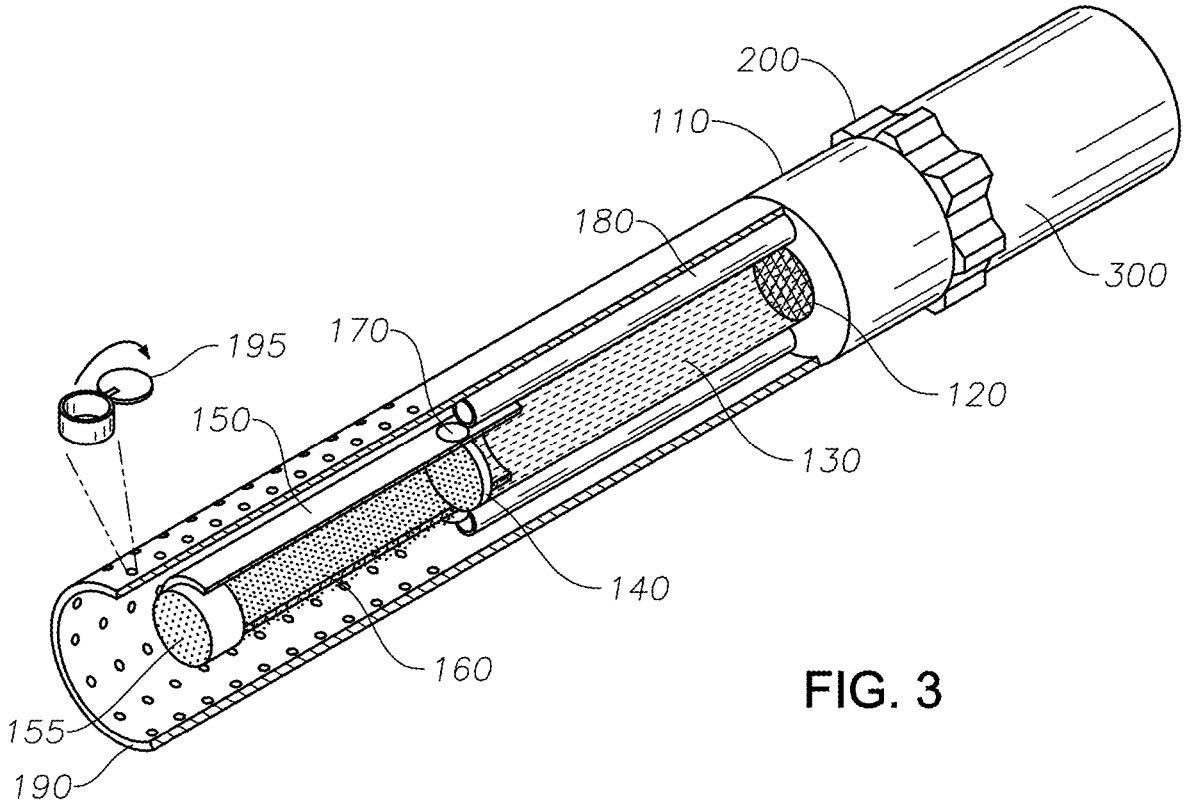
FIG. 3 is a perspective view of an embodiment of the steam generating tool.

The laser energy from surface unit 310 is converted in optics unit 110 to laser beam 130. Laser beam 130 can be a collimated beam or focused beam due to optics unit 110. A collimated beam, also referred to as a parallel beam, is a straight beam has uniform power intensity (power divide by area), to maximize interaction between laser beam 130 and activated carbon 160. A focused beam has a focal point and produces a conical shaped beam. In at least one embodiment, laser beam 130 is a collimated beam. Laser beam 130 can be pulsed as shown in FIG. 1 or can be continuous as shown in FIG. 3. In at least one embodiment, whether laser beam 130 is pulsed or continuous is a design feature of the laser manufacturer and thus originates in surface unit 310. In at least one embodiment, laser beam 130 can be pulsed due to a mechanical shutter.

Laser beam 130 travels through laser generating tool 100 to contact laser end 140 of activated carbon case 150. The distance between optical cover 120 and laser end 140 can depend on the size of steam generating tool 100. In at least one embodiment, the distance between optical cover 120 and laser end 140 is about 2 inches (5.08 centimeters). Activated carbon case 150 contains activated carbon 160. Laser end 140 can be any type of material that allows laser beam 130 to pass through while containing activated carbon 160 in activated carbon case 150. Laser end 140 can be an optical mesh, an optical cover, and combinations of the same. Laser end 140 can be any material that allows laser beam 130 to pass through without a change to its physical or chemical characteristics or its physical shape or dimensions. In at least one embodiment, laser end 140 can be an optical cover made of high heat, high pressure resistant materials. In at least one embodiment, laser end 140 is an optical cover made from sapphire, which is a high heat, high pressure resistant material.

Activated carbon case 150 can be constructed from activated carbon.

Activated carbon 160 can be any type of carbon the temperature of which can be increased without impacting the physical shape or dimensions of activated carbon 160. Advantageously, activated carbon is used because it can be rapidly heated when exposed to a laser beam, can be molded into any desired shape, and can be designed to have any size desired to fill activated carbon case 150. In at least one embodiment, activated carbon 160 in activated carbon case 150 can be in the shape of gravel.

Laser beam 130 travels through activated carbon case 150 contacting activated carbon 160 and increasing the temperature of activated carbon 160. Laser beam 130 stops traveling at reinforced end 155. Reinforced end 155 can be constructed from any material that can stop the transmission of laser beam 130 and contain activated carbon 160 in activated carbon case 150. Reinforced end 155 prevents the leak of activated carbon 160. In at least one embodiment, reinforced end 155 is a plug in activated carbon case 150.

Water supply pipes 180 carry water from the surface to steam generating tool 100. Water supply pipes 180 can be any type of piping that is high pressure resistant, high heat resistant. In at least one embodiment, water supply pipes 180 can be constructed from activated carbon. Water supply pipes 180 can be in contact with laser beam 130 as described with reference to FIG. 1 and FIG. 3 or can be separate from laser beam 130 as described with reference to FIG. 4. In certain embodiments, optics unit 100 can size and shape laser 130 to contact water supply pipes 180. In embodiments where laser beam 130 contacts water supply pipes 180 heating of the water in water supply pipes 180 can occur. Advantageously, the use of activated carbon is more efficient than using a laser to heat water directly, which can lose about 33% of energy per inch of water. Thus, the contact between the water in water supply pipes 180 and laser beam 130 is a pre-heating, with the primary heat in steam generating tool 100 being the activated carbon. Steam generating tool 100 can contain one water supply pipe 180, two water supply pipes 180, or more than two water supply pipes. The size of water supply pipes 180 can depend on the desired flow rate of water to be supplied to steam generating tool 100 and the size of steam generating tool 100. The flow rate of the water through water supply pipes 180 can be based on the volume of activated carbon and the target temperature. Each water supply pipe 180 terminates proximate to laser end 140 of activated carbon case 150, such that as the water exits water supply pipe 180 it contacts activated carbon case 150. The water does not contact the activated carbon directly, but the radiant heat from activated carbon case 150 heats the water to produce the steam. Each water supply pipe 180 terminates in one-way valve 170.

One-way valve 170 is any type of valve allowing flow in only one direction, such that water can flow from the surface through water supply pipes 180 but cannot flow back toward the surface. In at least one embodiment, one-way valve 170 is a check valve.

Steam generating tool 100 is encased in outer case 190. Outer case 190 can be constructed from any high pressure, high temperature resistant material. Outer case 190 proximate to and surrounding activated carbon case 150 is perforated with each perforation containing release valve 195. Release valves 195 can be any type of valve configured to allow steam to flow through without allow fluid to flow back into steam generating tool 100. In at least one embodiment, each release valve 160 can be a check valve. Each release valve 195 can be operated according to a release set point such that each release valve 195 opens when the release set point is reached. Opening release valves 195 on a release set point ensures that the steam released in the formation is released with force. The release set point can be a pressure less than the formation cracking pressure, such that the released steam does not crack the formation. The release set point can be between 800 psi (5,515 kPa) and 1200 psi (8,273 kPa).

The steam released into the formation can be at a temperature greater than 204° C. (400° F.), alternately between 204° C. (400° F.) and 300° C. (572° F.), alternately between 204° C. (400° F.) and 250° C. (482° F.), and alternately between 204° C. (400° F.) and 225° C. (437° F.). In at least one embodiment, the steam is at a temperature greater than 204° C. (400° F.). Advantageously, maintaining the temperature of the steam in this range can eliminate damage to the formation. The temperature of the steam can be controlled by the amount of activated carbon, the power of laser beam 130, and the exposure time.

An annulus forms between outer case 190 and activated carbon case 150. The heat from hot activated carbon radiates to the annulus and water supply pipe 180 terminates in the annulus such that water exiting water supply pipe 180 exits into the annulus.

Figure 4:
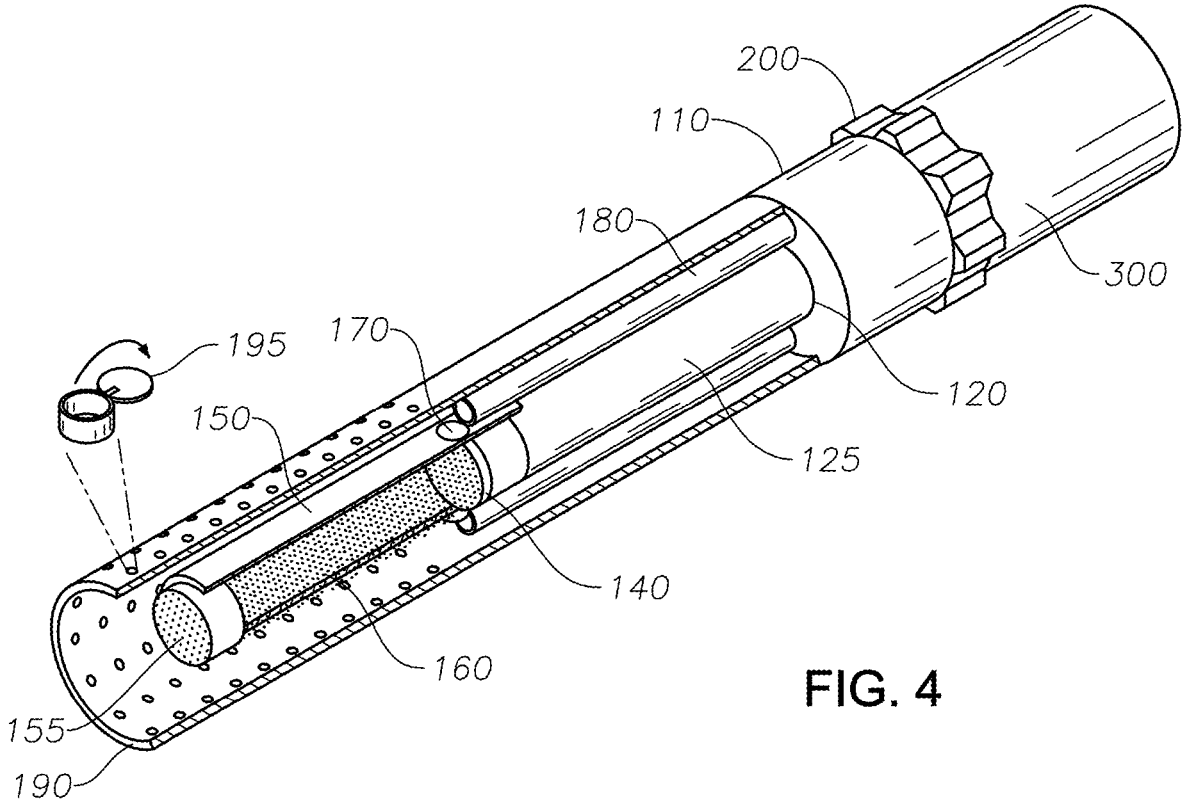
FIG. 4 is a perspective view of an embodiment of the steam generating tool.

Referring to FIG. 4, an embodiment where water supply pipes 180 are separate from and do not come in contact with laser beam 130 is described. Optical case 125 extends from optical unit 110 containing the laser beam and the optical cover. Optical case 125 can be any type of material that can isolate a laser beam. Optical case 125 isolates the laser beam such that the laser beam does not contact the water flowing in water supply pipes 180. Laser generating tool 100 can include optical case 125 to isolate the laser beam when the reservoir temperature is high and the water in the pipes is already pre-heated.

Steam generating tool 100 is designed such that no steam is produced in water supply pipes 180.

While steam generating tool 100 is shown as a cylinder, one of skill in the art will appreciate that steam generating tool 100 can be any shape allowing steam generating tool to be placed in a wellbore.

Figure 5:
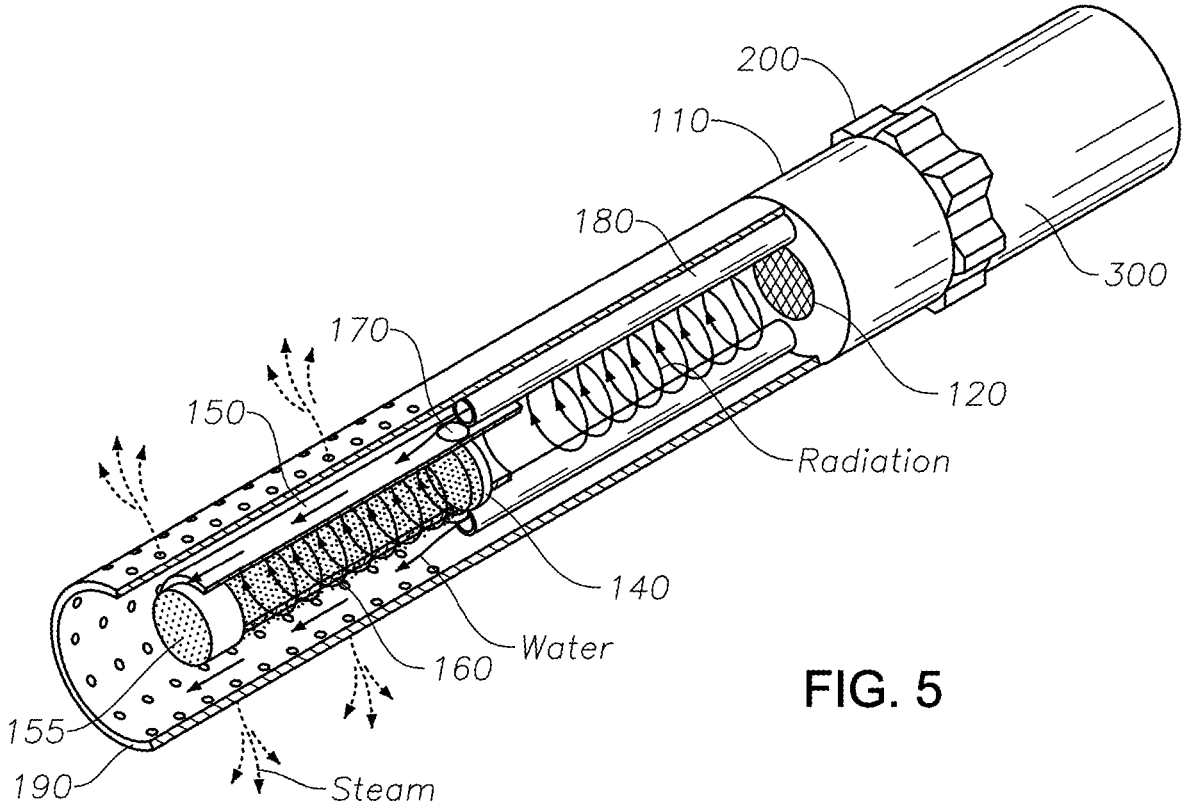
FIG. 5 is a perspective view of an embodiment of the steam generating tool.

The operation of steam generating tool 100 can be understood with reference to FIG. 5. Laser beam 130 heats activated carbon 160 such that the temperature of activated carbon can be increased in activated carbon case 150 to produce hot activated carbon at a target temperature. The target temperature of hot activated carbon can be between 800° C. and 1795° C., and alternately between 1564° C. and 1795° C. The target temperature is less than the combustion temperature of the activated carbon. The target temperature of hot activated carbon can be determined in a lab based on the volume of activated carbon, the power of the laser, and the desired heating time. In at last one embodiment, the target temperature is 1795° C. The step of increasing the temperature of activated carbon 160 can take between 30 seconds and 3 minutes depending on the volume of activated carbon in activated carbon case 150.

The heat from the hot activated carbon radiates from activated carbon case 150 increasing a temperature in the annulus between activated carbon case 150 and outer case 190. The temperature can reach 1750° C. in the annulus between activated carbon case 150 and outer case 190. As water exits water supply pipes 180 through one-way valve 170 the heat converts the water to steam. The steam produced is high steam quality superheated steam.

The steam is released from steam generating tool 100 through release valves 190.

Returning to FIG. 2, an embodiment of using steam generating tool 100 is described with reference to FIGS. 1 and 3-4. Surface unit 310 sits at surface 330 proximate to wellbore 340. Wellbore 340 transects formation 320. Steam generating tool 100 is positioned in formation 320. The steam released through release valves 190 can increase a temperature of formation 320 in performing a wellbore activity.

The steam escaping from steam generating tool 100 can be used for a wellbore activity. Wellbore activities can include increase a temperature of a formation without damaging the formation, improve the efficiency of increasing a temperature of a wellbore, wellbore clean-up, stimulating a reservoir, improving the efficiency of laser material interaction, steam assisted oil recovery, injecting steam from an offshore platform into an offshore reservoir, and combinations of the same. Advantageously, the steam generating tool described can be used to generate and inject steam on offshore platforms where conventional steam generators are bulky and cannot fit on offshore platforms. When used in an offshore environment, the surface on which the laser unit sits is the offshore platform.

The steam generating tool is in the absence of steam traveling through the wellbore from the surface as the steam is produced in-situ. The steam generating tools is in the absence of microwaves or microwave energy. The steam generating tool is in the absence of ceramic materials. The use of the steam generating tool is in the absence of ceramic materials deployed in the wellbore and formation. While residual or naturally-occurring water in the formation can be converted to steam, the use of the steam generating tool does not rely on the presence of such water to produce steam, rather the water required to produce steam is piped into the steam generating tool. The steam generating tool is in the absence of injecting water into the formation. In the steam generating tool and methods for producing in-situ steam, the activated carbon does not ignite or combust upon application of the laser beam. The steam generating tool is in the absence of heating the formation directly with the laser, which is inefficient. The steam generating tool operates in the absence of explosive force. The steam released through the steam generating tool does not penetrate or spall the formation surrounding the steam generating tool.

Example. The Example demonstrates that a laser can be used to increase a temperature of activated carbon to produce hot activated carbon.

Figure 6:
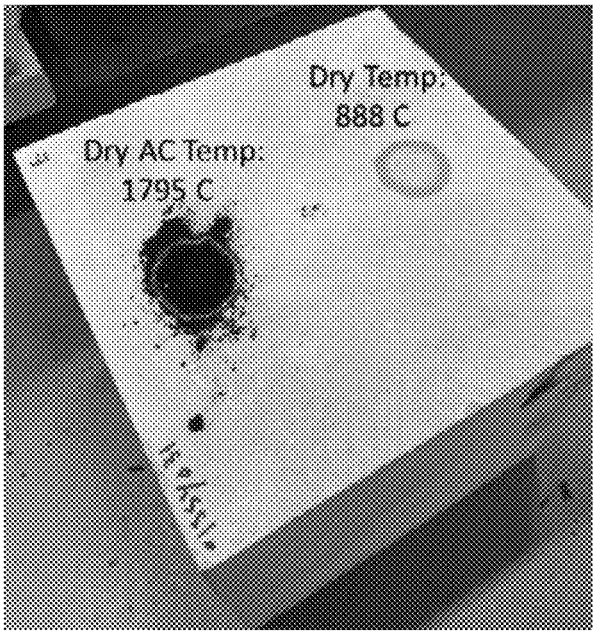
FIG. 6 is a pictorial representation from the Example.

One area of a block of limestone was covered with activated carbon, as shown in FIG. 6. A second area was left exposed without activated carbon. A laser beam of 1 kW was emitted on both areas, with and without activated carbon. An infra-red (IR) camera was used to capture the temperature of the limestone black in the two areas after being heated for a duration of 30 seconds.

Figure 7A:
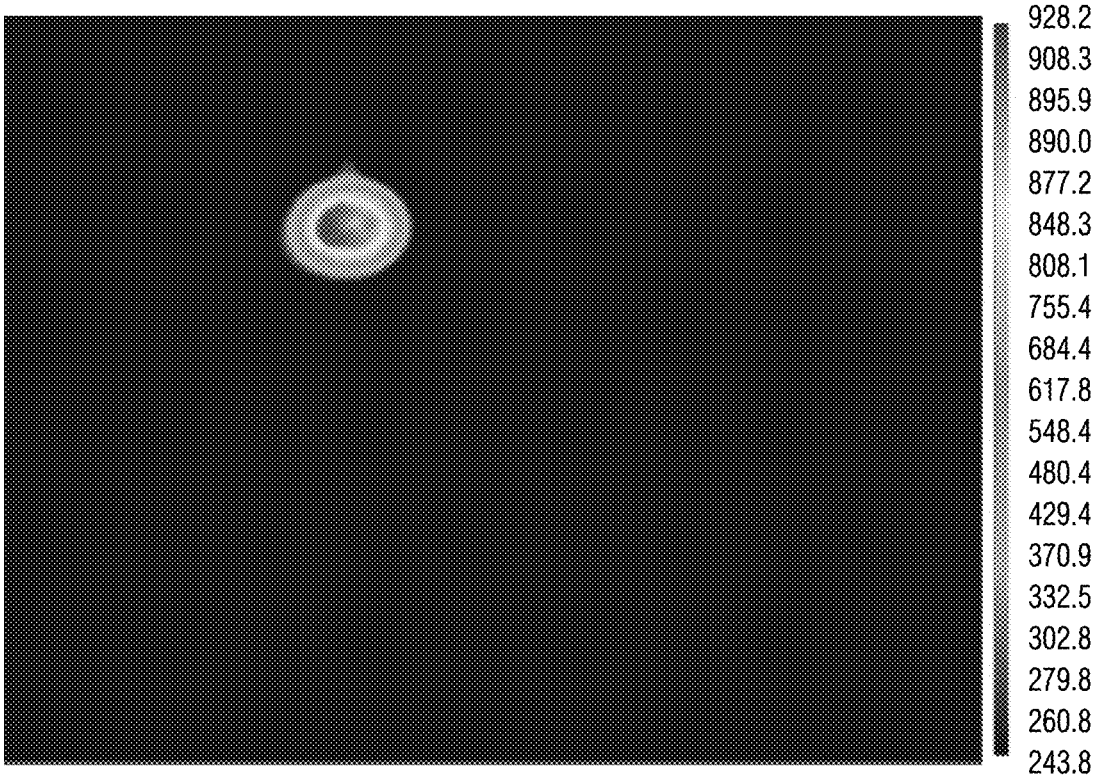
FIG. 7A is a pictorial representation of results from an IR camera from the Example.
Figure 7B:
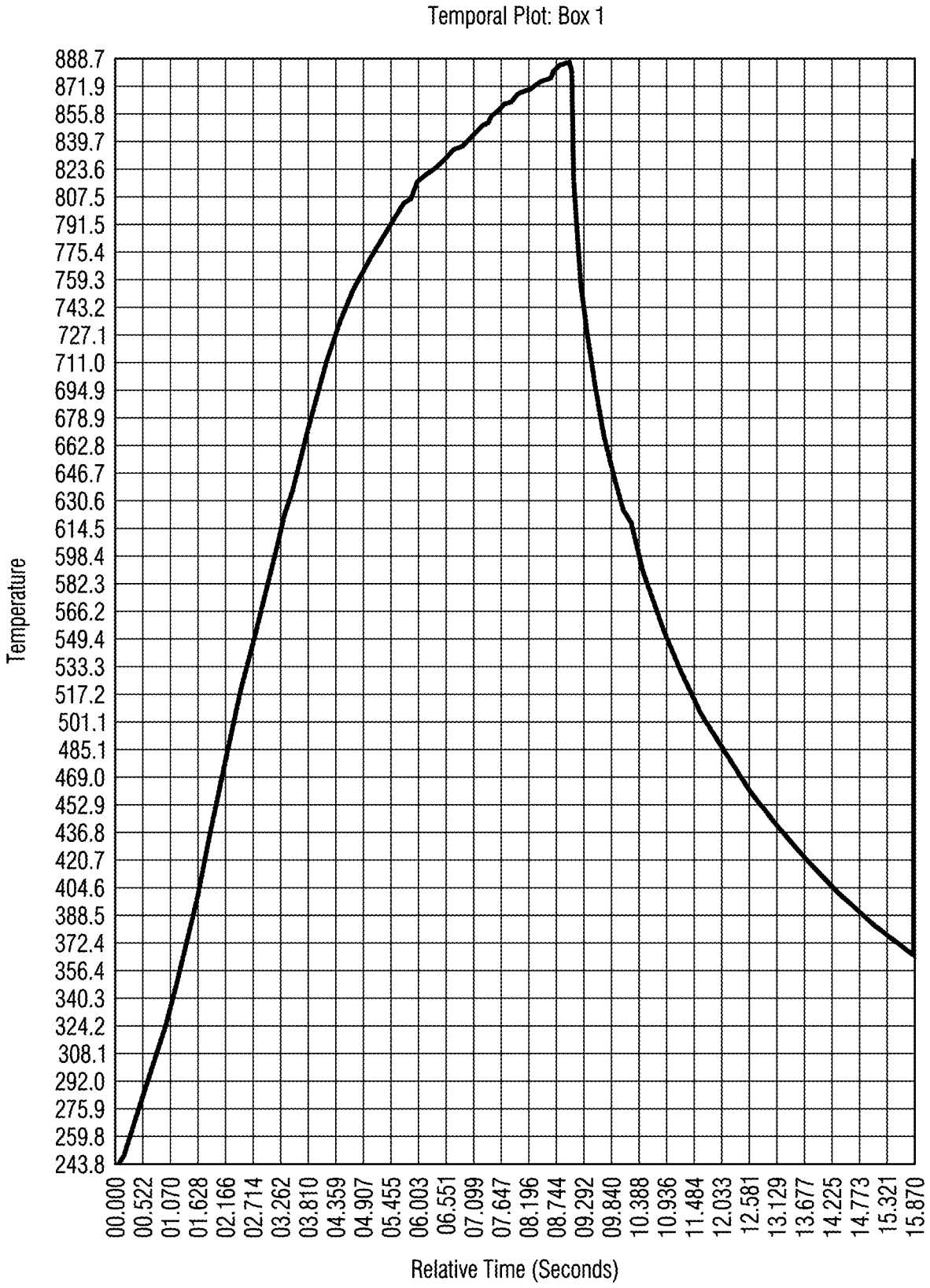
FIG. 7B is a graphical representation of data from an IR camera from the Example.
Figure 8A:
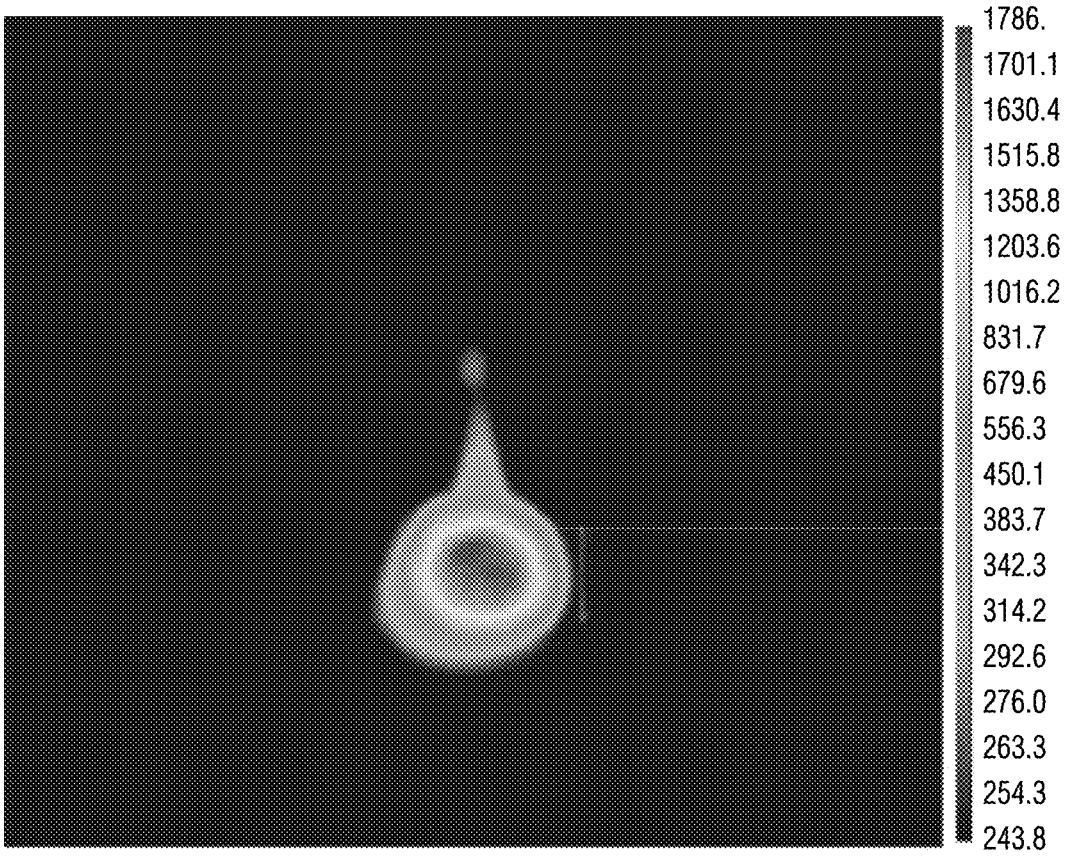
FIG. 8A is a pictorial representation of results from an IR camera from the Example.
Figure 8B:
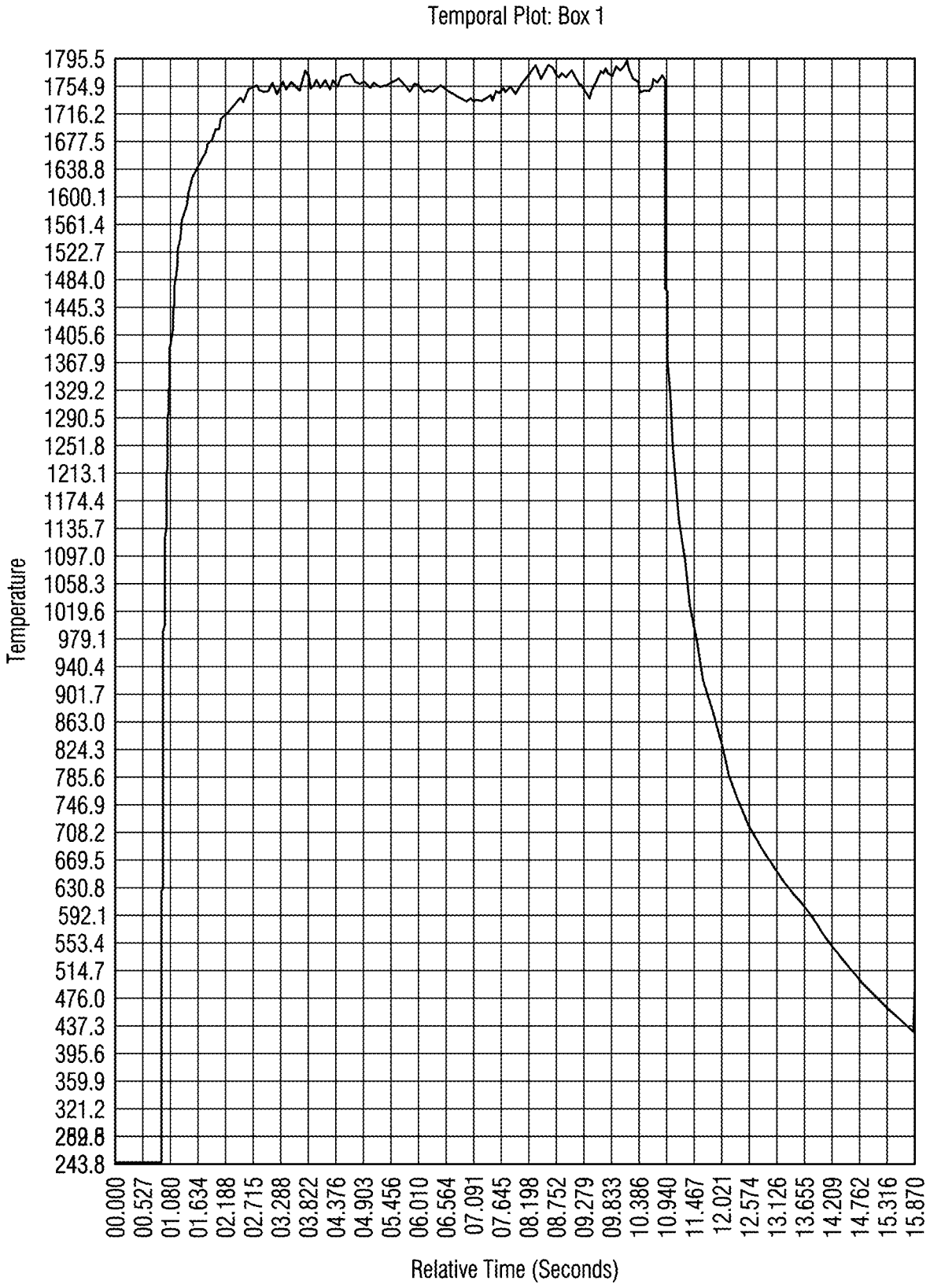
FIG. 8B is a graphical representation of data from an IR camera from the Example.

The maximum temperature reached in the area without activated carbon recorded by the IR camera was 888° C. as shown in FIG. 7A and FIG. 7B. FIG. 7A shows the IR image of the block of limestone heated with the laser in the area without activated carbon. FIG. 7B shows the data collected by the IR camera. The maximum temperature reach in the area with activated carbon recorded by the IR camera was 1795° C. FIG. 8A shows the IR image of the block of limestone heated with the laser in the area with activated carbon. FIG. 8B shows the data collected by the IR camera.

In addition to demonstrating the concept, the example shows that the temperature increase is more effective using activated carbon compared to rocks, such as limestone.

Although the technology has been described in detail, it should be understood that various changes, substitutions, and alterations can be made hereupon without departing from the inventive principle and scope. Accordingly, the scope of the embodiments should be determined by the following claims and their appropriate legal equivalents.

The singular forms "a," "an," and "the" include plural referents, unless the context clearly dictates otherwise.

Optional or optionally means that the subsequently described event or circumstances can or may not occur. The description includes instances where the event or circumstance occurs and instances where it does not occur.

Ranges may be expressed as from one particular value to another particular value. When such a range is expressed, it is to be understood that another embodiment is from the one particular value to the other particular value, along with all combinations within said range.

Throughout this application, where patents or publications are referenced, the disclosures of these references in their entireties are intended to be incorporated by reference into this application, in order to more fully describe the state of the art, except when these references contradict the statements made here.

As used here and in the appended claims, the words "comprise," "has," and "include" and all grammatical variations thereof are each intended to have an open, non-limiting meaning that does not exclude additional elements or steps.

What is claimed is:

1. An apparatus for producing in-situ steam comprising:

a rotational joint physically connected to a fiber optic cable, the rotational joint configured to rotate a steam generating tool around an axis;

the steam generating tool, the steam generating tool comprising:

an optics unit physically connected to the rotational joint, the optics unit configured to shape and manipulate laser energy delivered to the optics unit through the fiber optic cable to produce a laser beam;

an optical cover optically connected to the optics unit, the optical cover configured to protect the optics unit;

an activated carbon case optically connected to the optics unit, the activated carbon case configured to contain activated carbon, the activated carbon case comprising:

a laser end proximate to the optical cover, the laser end configured to allow the laser beam to pass while containing the activated carbon, a reinforced end opposite the laser end, the reinforced end configured to stop the laser beam while containing the activated carbon, wherein the laser beam travels from the optical cover to the laser end of the activated carbon case through the activated carbon case and ends at the reinforced end, and activated carbon configured to retain and radiate heat;

an outer case physically surrounding the activated carbon case, wherein an annulus is formed between the outer case and the activated carbon case, wherein heat from the activated carbon radiates to the annulus; and water supply pipes configured to carry water to the annulus, wherein each water supply pipe terminates in a one-way valve, wherein the outer case comprises release valves.

2. The apparatus of claim 1, further comprising:

a surface unit configured to produce laser energy, wherein the surface unit sits on a surface; and the fiber optic cable configured to transmit the laser energy from the surface unit to the steam generating tool.

3. The apparatus of claim 1, wherein the laser end is selected from an optical mesh, an optical, and combinations of the same.

4. The apparatus of claim 1, wherein the activated carbon case is constructed from activated carbon.

5. The apparatus of claim 1, wherein the one-way valve is a check valve.

6. The apparatus of claim 1, wherein the activated carbon is in the shape of gravel.

7. The apparatus of claim 1, wherein the optics unit comprises one or more lenses.

8. The apparatus of claim 1, wherein the steam generating tool further comprises an optical case extending from the optical unit to the laser end, the optical case configured to isolate the laser beam from the water supply pipes.

9. A method of producing in-situ steam, the method comprising the steps of:

producing laser energy in a surface unit;

transmitting the laser energy to a steam generating tool through a fiber optic cable;

converting the laser energy to a laser beam in an optics unit of the steam generating tool;

emitting the laser beam from the optics unit to an activated carbon case, wherein the laser beam enters the activated carbon case through a laser end, wherein the activated carbon case comprises activated carbon, wherein the laser beam contacts the activated carbon;

increasing a temperature of the activated carbon to produce a hot activated carbon;

radiating heat from the activated carbon to an annulus between an outer case and the activated carbon case, wherein the temperature in the annulus is 1750° C.;

introducing water from a water supply pipes to the annulus;

producing steam in the annulus due to the increase in temperature of the water in the annulus; and releasing the steam through release valves in the outer case.

10. The method of claim 9, wherein the surface unit sits at a surface proximate to a wellbore in a formation such that the steam released through the release valves increases a temperature of the wellbore in the formation.

11. The method of claim 9, wherein the laser beam is a pulsed laser beam.

12. The method of claim 9, wherein the laser beam is a continuous laser beam.

13. The method of claim 9, further comprising the step of pre-heating the water in the water supply pipes due to contact between the laser beam and the water supply pipes.

14. The method of claim 9, wherein the step of increasing the temperature of the activated carbon is a duration of 30 seconds to 3 minutes.

15. The method of claim 9, further comprising the step of rotating the steam generating tool such that steam is evenly distributed from the release valves.

* * * * *